United States Patent [19]

Alderman

[11] 4,147,003

[45] Apr. 3, 1979

[54] INSULATED ROOF

[75] Inventor: Robert J. Alderman, Bradenton, Fla.

[73] Assignee: Butler Manufacturing Company, Kansas City, Mo.

[21] Appl. No.: 832,656

[22] Filed: Sep. 12, 1977

Related U.S. Application Data

[63] Continuation-in-part of Ser. No. 638,329, Dec. 8, 1975, Pat. No. 4,047,345, which is a continuation-in-part of Ser. No. 494,097, Aug. 2, 1974, Pat. No. 3,969,863, which is a continuation-in-part of Ser. No. 656,642, Feb. 9, 1976, Pat. No. 4,047,346, and Ser. No. 649,911, Jan. 16, 1976, Pat. No. 4,075,807.

[51] Int. Cl.[2] ..... E04B 2/28; E04B 2/60; E04F 21/00

[52] U.S. Cl. ..... 52/309.8; 52/404; 52/407; 52/461; 52/743

[58] Field of Search ..... 52/404, 407, 408, 743, 52/461, 309.8, 478, 728

[56] References Cited

U.S. PATENT DOCUMENTS

| | | | |
|---|---|---|---|
| 195,593 | 9/1877 | Evans | 52/407 |
| 709,257 | 9/1902 | Cottrell | 52/404 |
| 2,287,400 | 6/1942 | Wells, Jr. | 52/407 X |
| 3,296,761 | 1/1967 | Varlonga | 52/278 |
| 3,559,914 | 2/1971 | Alderman | 242/86.52 |
| 3,662,509 | 5/1972 | Studzinski | 52/478 |
| 3,969,863 | 7/1976 | Alderman | 52/90 X |
| 4,047,345 | 9/1977 | Alderman | 52/407 X |
| 4,047,346 | 9/1977 | Alderman | 51/90 X |
| 4,075,807 | 2/1978 | Alderman | 52/407 |

FOREIGN PATENT DOCUMENTS

| | | | |
|---|---|---|---|
| 648973 | 8/1964 | Belgium | 52/728 |
| 1904484 | 10/1970 | Fed. Rep. of Germany | 52/90 |
| 2315793 | 10/1974 | Fed. Rep. of Germany | 52/407 |
| 2329372 | 1/1975 | Fed. Rep. of Germany | 52/407 |
| 2340309 | 2/1975 | Fed. Rep. of Germany | 52/407 |
| 7203154 | 9/1973 | Netherlands | 52/309.8 |
| 516060 | 1/1972 | Switzerland | 52/309.8 |
| 659227 | 10/1951 | United Kingdom | 52/478 |

*Primary Examiner*—Alfred C. Perham
*Attorney, Agent, or Firm*—Jones, Thomas & Askew

[57] ABSTRACT

A reel of flexible sheet material of a width wider than the space between adjacent ones of the purlins in a roof structure is mounted on a support framework over a space between adjacent ones of the purlins. The framework is moved along the purlins and the reel of sheet material is progressively unrolled and the sheet material is formed and guided by the framework down into the space between the adjacent purlins to create a trough in the space between the adjacent purlins. Insulation material is placed in and supported in the trough of sheet material and additional hard insulation can be applied to the upper and lower flanges of the purlins and also can be applied to the purlins to span the space between adjacent ones of purlins. Hard sheets of roofing material are applied to the purlins to cover the roof structure.

12 Claims, 5 Drawing Figures

INSULATED ROOF

CROSS REFERENCE TO RELATED APPLICATIONS

This application is a continuation-in-part of application Ser. No. 638,329, filed Dec. 8, 1975, now U.S. Pat. No. 4,047,345, which was a continuation-in-part of application Ser. No. 494,097 filed Aug. 2, 1974, now U.S. Pat. No. 3,969,863. This application is also a continuation-in-part of application Ser. No. 656,642, filed Feb. 9, 1976, now U.S. Pat. No. 4,047,346, and of application Ser. No. 649,911, filed Jan. 16, 1976, now U.S. Pat. No. 4,075,807.

BACKGROUND OF THE INVENTION

The roof structure of an industrial building typically comprises rafter beams which extend parallel to one another across the building and slope from the center of the building down toward its sides, and purlins which extend parallel to one another and which extend across and are mounted on the rafter beams. Hard sheets of exterior roofing material extend over and are attached to the purlins. In the past, when a roof structure of an industrial building was to be insulated, elongated sheets of insulation material were stretched across the purlins and the sheets of hard roofing material were attached to the purlins through the insulation material. The relatively thin sheets of insulation material were applied to the roof structure by the workmen using the sheets of hard roofing material which were already installed in the roof structure as a working surface. Reels of insulation material were first unwound on the hard sheets of roofing material and the long sheets of insulation material were moved by hand over onto the exposed purlins adjacent the hard roofing material and the lengths of the sheets of insulation material extended across the lengths of the purlins. The sheets of insulation material were stretched to prevent sagging between the purlins, and the hard roofing material was then placed over the insulation material and connected to the purlins.

As set forth in my prior U.S. Pat. No. 3,559,914, it has now become common practice to extend the sheets of insulation material along the lengths of the purlins, instead of across the purlins, so as to eliminate the seams between adjacent sheets of insulation material from being exposed inside the building. The new procedure as set forth in my patent has reduced hazards to workmen on the roof by maintaining the reels of insulation material in a relatively static and available position on the exposed purlins without exposing long lengths of a sheet of material to the wind while the workmen remain on the sheets of hard roofing material, so that the occasions when the workmen might be tempted to walk or climb out on the purlins to place or adjust the sheets of insulation material have been reduced.

SUMMARY OF THE INVENTION

Briefly described, the present invention comprises an insulated roof structure which includes improved means for insulating the roof structure. The improved means of insulation includes filling the spaces between adjacent ones of purlins with insulation, such as loose or batten heat insulation material of varying desired thicknesses, with the insulation being supported between the adjacent ones of purlins by a trough formed of flexible air impervious sheet material. The trough is formed by unrolling the air impervious sheet material along the tops of adjacent ones of the purlins in the partially completed roof structure. The sheet material can be of varying width but, preferably, is at least wider than the distance between mid-points on the top flanges of adjacent ones of purlins. The wider the sheet material, the further the material can hang down between the adjacent purlins resulting in a deeper trough and thus a thicker layer of insulation can be supported by the trough. The side edges of the flexible sheet material rest on the top surfaces of the upper laterally extending flanges of the adjacent ones of purlins while the center portion of the sheet material sags into the space between the purlins. The flexible sheet material in the disclosed embodiment is supported by a lattice of support straps below the sheet material extending through openings in the purlins or resting on the rafters, or by attaching the sheet material at its side edges to the purlins.

In the preferred embodiment of the invention, the outer edges of the sheet material overlap, on the upper laterally extending purlin flanges, the outer edges of similar adjacent sheets extending between the next pair of purlins. These outer edges are held in place by the fastening of the metal roofing panels to the purlins.

Also taught by this invention is the use of foam board or other solid insulation material to cover insulation gaps created by the metal purlins and the gaps between the purlins between the hanging troughs. Solid insulation material is fastened to the upper and lower flanges of the purlins. The solid insulation board covering the upper laterally extending flanges of the purlins can take the form of a board just wide enough to cover one of the purlins or it can be wide enough to span the space between adjacent purlins. The solid insulation material covering the lower extending flange of the purlin need only be wide enough to cover the flange and possibly any gaps beneath the upper laterally extending flange of the purlin to which it is attached and the flexible sheet material.

Thus it is an object of this invention to provide an improved insulated roof structure wherein insulation in the form of either loose or batten insulation can be expediently installed in the roof structure in varying desired thicknesses.

Other objects, features and advantages of the present invention will become apparent upon reading the following specification, when taken in conjunction with the accompanying drawings.

DETAILED DESCRIPTION

Figure 2:
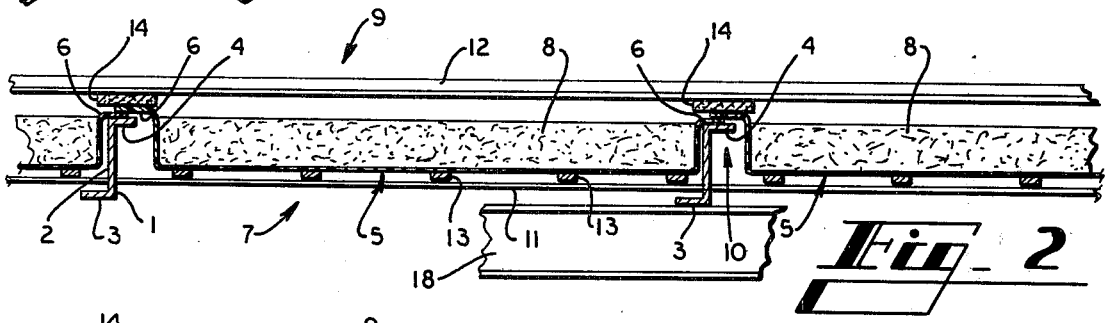
FIGS. 2,3, and 4 are each side cross sectional view of a portion of a completed roof, with each figure illustrating different roof insulation arrangements.

Referring now in more detail to the drawings, in which like numerals indicate like parts throughout the several views, FIG. 2 illustrates the roof structure 9 which includes a plurality of spaced parallel purlins 1 mounted on rafters 18. The purlins 1 each include a central web 2, lower flange 3 and upper flange 4.

Figure 1:
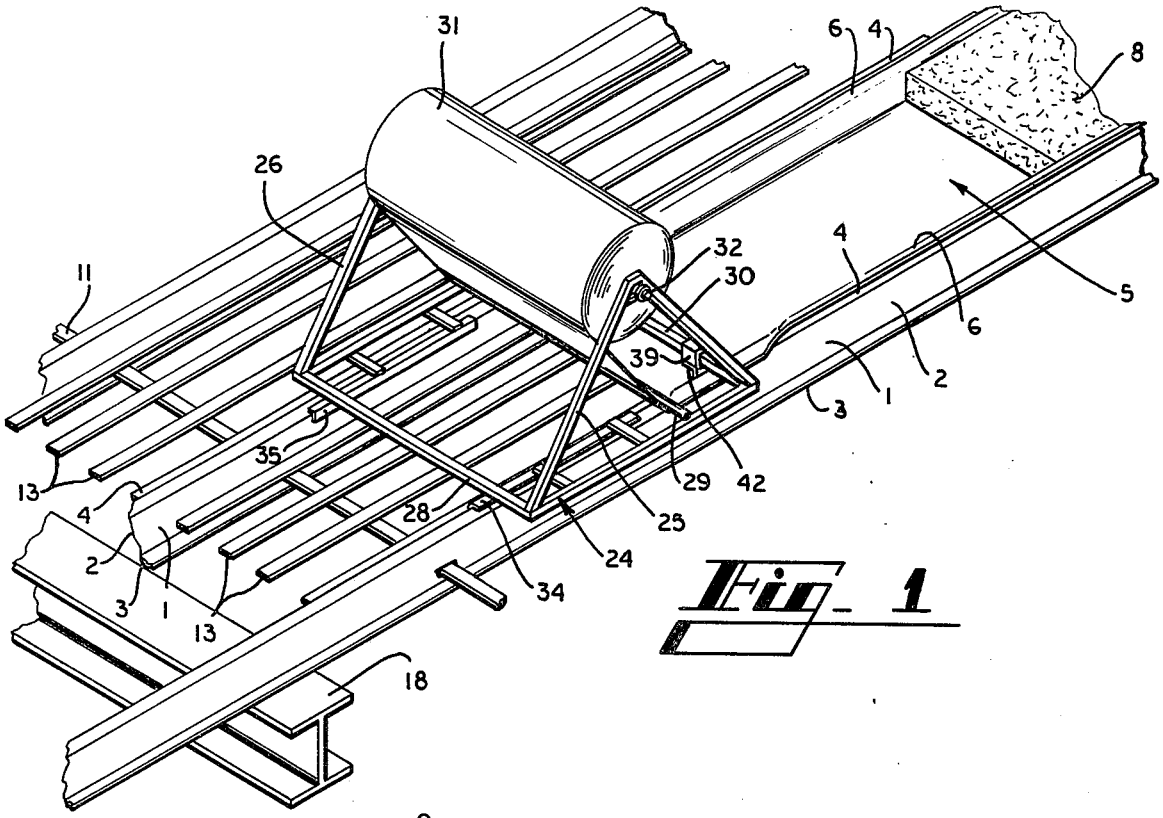
FIG. 1 is a partial perspective view of a partially completed roof structure of an industrial building, showing a pair of adjacent purlins, a lattice of support straps, a reel of flexible sheet material supported by a reel support framework, and insulation material.

A flexible sheet material 5 is unrolled along the upper flange 4 of adjacent ones of purlins, as shown in FIG. 1.

The outer edges 6 of the sheet material are left on the upper laterally extending edges 4 of the purlins 1. The elongate center portion of the sheet material sags down between the central web 2 of adjacent ones of purlins 1, thus forming a trough 7. The trough is filled with insulation material 8, loose or batten. If batt or blanket-type insulation 8 is used, the shape of the structure is more flat, as shown in the drawings. If loose insulation is used, a more sagging appearance is created in the strips of flexible sheet material 5, but a more stiff sheet material 5 tends to provide a more uniform appearance. Abutting edges 6 of adjacent sheets of flexible material 5 overlap one another on top of the upper flange 4 of purlins 1 as shown in FIG. 2 at 10 and are held in place by the fastening of metal roof panel 12 to the upper flange 4 of purlin 1. Preferably, the overlapping edge portions of the strips of sheet material 5 are connected together as by adhesive or by heat sealing, depending on the characteristics of the material, the climate conditions and working conditions. This provides an effective vapor barrier beneath the hard roofing material.

A lattice of support straps or banding is formed in the roof structure, with the lattice comprising cross straps 11 under tension extending through openings in the central webs 2 of the purlins 1 and with longitudinal straps 13 extending parallel to the lengths of the purlins. The lattice is used as an aid in supporting the bottom side of the trough 7. The support lattice can be formed from cross straps 11 extending through the purlins 1 without the longitudinal straps 13, or the lattice can comprise longitudinal straps 13 resting on the rafters 18 (FIG. 3).

Figure 3:
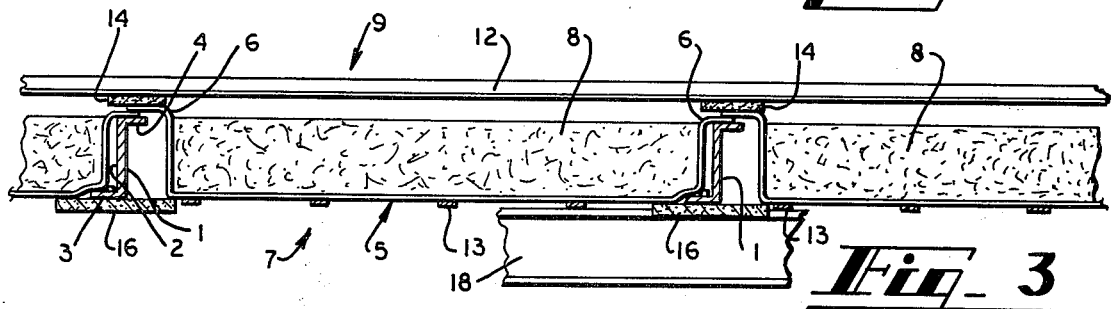
Figure 4:
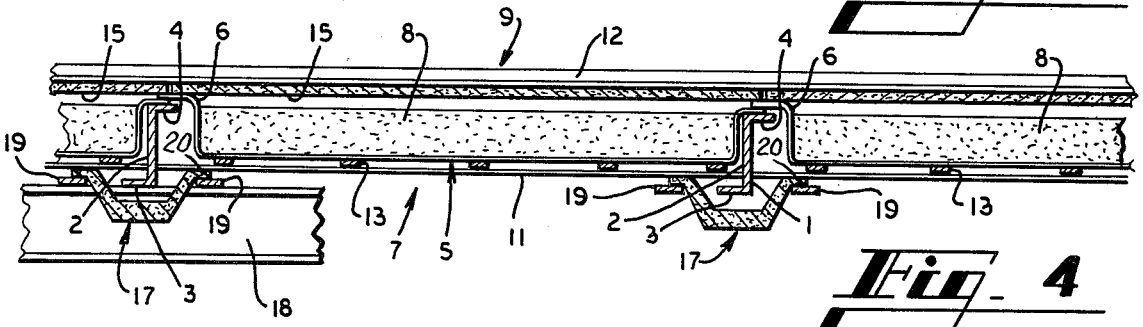

FIGS. 3 and 4 show the use of solid insulation board for insulating the gaps between the insulation troughs 7. The upper flange 4 of purlins 1 can be insulated by placing along the top edge of the upper flange 4 a piece of solid insulation board 14 which is only slightly wider than the upper flange 4 itself or, an insulation board 16 can be used which rests on the top side of the upper lateral flange 4 and spans the entire space between adjacent ones of purlins. The underside of the purlins has a slightly wider gap to insulate and as a result slightly wider or insulation board 16, 17 is used to insulate the gap. If the channel insulation formed by the strips of sheet material 5 rest on a support lattice 11–13 that is mounted on the rafters 18 of the building, flat insulation board 16 (FIG. 3) can be used by directly riviting the insulation boards to the bottom surface of the lower flanges 3 of the purlin. If, however, the channel insulation is supported by the lattice of support straps at a higher elevation (FIG. 4) a channel-shaped board 17 is used with side flanges 20, and additional straps 19 can be placed over the rafters 18 to engage the flanges as illustrated, or the straps 13 in the support lattice 11–13 on opposite sides of the purlins can be used (not shown). The insulation board can be fabricated from various suitable materials such as glass reinforced cellular plastic isocyanurate insulation.

Figure 5:
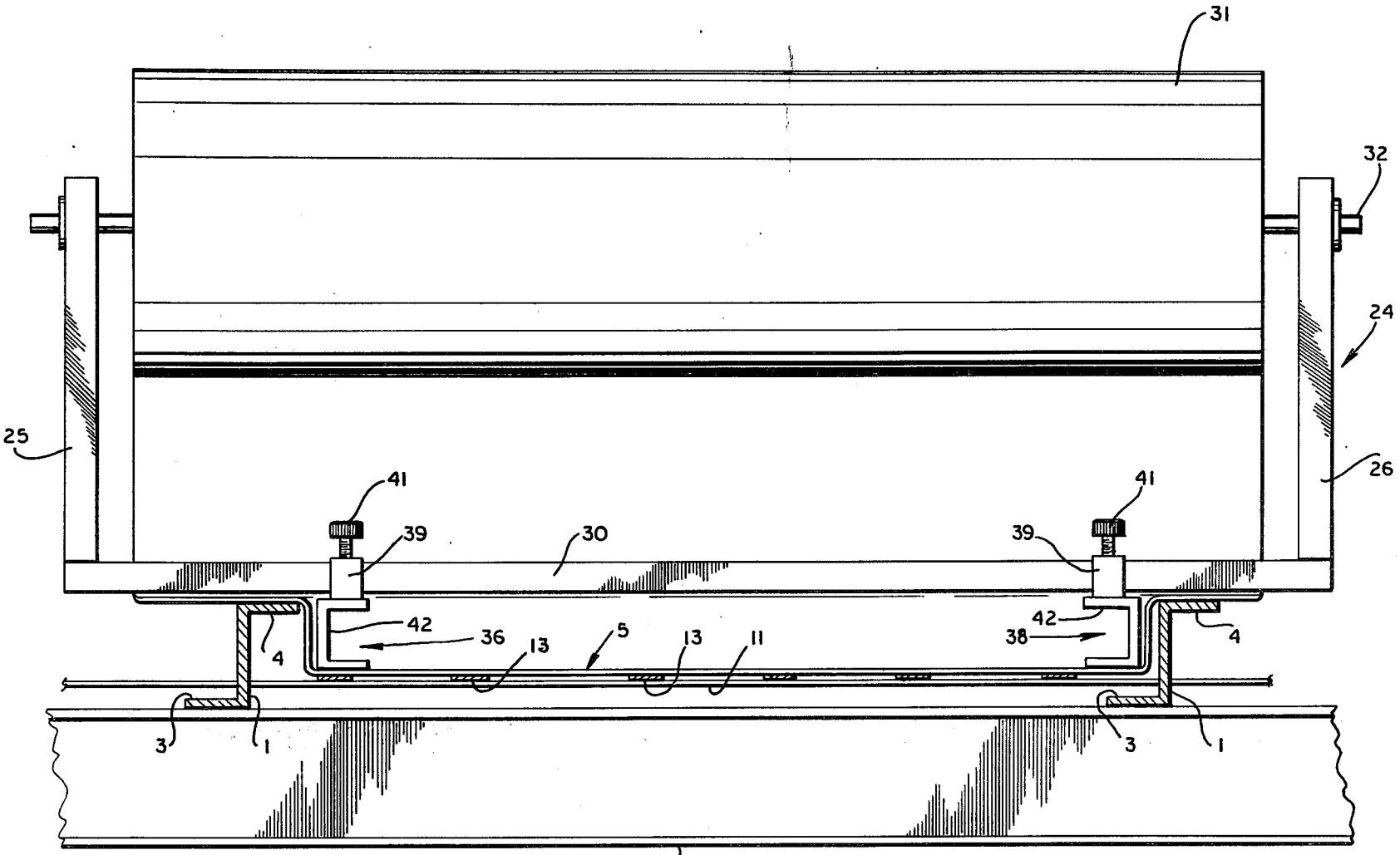
FIG. 5 is a front view of the reel support apparatus.

As illustrated in FIGS. 1 and 5, the reel support framework 24 comprises a pair of triangular side frames 25 and 26 and lower spacer bars 28, 29 and 30 extending across the bottom of the framework. A reel 31 of the flexible sheet material is supported at the upper apexes of the triangular side frames 25 and 26 on support bar 32, and the free end of the sheet material moves from reel 31 beneath lower spacer bars 29 and 30. Bottom runners 34 and 35 are mounted on the bottom of the framework 24 and hold the framework on a pair of adjacent ones of the purlins 1. A pair of sheet guides 36 and 38 are slidably mounted on the rear spacer bar 30, and clamps 39 and 40 of the sheet guides are slidably mounted on the bar 30. Set screws 41 allow the clamps 39 and 40 to be attached to the bar 30 at variable positions along the length of the bar. U-shaped guide elements 42 are mounted on the clamps 39 and 40 and project downwardly from the framework into the space between adjacent ones of the purlins. When the framework is pushed along the purlins, the sheet material unrolls from its reel 31, passes beneath the lower spacer bars 29 and 30, and the sheet guides 36 and 38 urge the central portion of the strip of sheet material downwardly between the purlins. The side edge portions of the strip of sheet material are therefore guided onto the top surfaces of the upper flanges 4 of the purlins 1.

When the strip of sheet material has been formed in the manner illustrated in FIG. 5, by forming a trough between the purlins, the insulation material is then placed in the trough. For example, loose insulation can be blown into the troughs, batt insulation can be placed by workers standing on the already installed hard roofing material down into the troughs, or blanket insulation can be fed from reels down into the troughs.

It will be understood that the foregoing relates only to a disclosed embodiment of the present invention, and that numerous changes and modifications may be made therein within the scope of the invention as defined in the following claims.

I claim:

1. A roof structure comprising a plurality of rafters and the like oriented in spaced approximately parallel relationship with respect to one another, a plurality of purlins supported by said rafters in spaced approximately parallel relationship with respect to one another and extending across said rafters, each of said purlins including an upper laterally extending flange, a central web and a lower laterally extending flange, sheets of hard roofing material and the like supported by the upper laterally extending flanges of said purlins, fasteners connecting said sheets of hard roofing material to the upper laterally extending flanges of said purlins, elongated strips of flexible sheet material extending along the lengths of the spaces between said purlins and spanning the spaces between adjacent ones of the purlins, the outer edges of said strips of flexible sheet material resting on the top surfaces of the upper laterally extending flanges of adjacent ones of said purlins with the portions of said strips between said purlins extending down to a lower level into the space between the central webs of said purlins and forming troughs between said purlins, insulation material positioned in the troughs of said sheet material and substantially filling the troughs up to said sheets of hard roofing material.

2. The roof structure of claim 1 wherein said material spanning the space between purlins and supporting insulation is made of air impervious vinyl material.

3. The roof structure of claim 1 and further including strips of insulation material resting upon the upper laterally extending flanges of said purlins between said purlins and said hard sheets of roofing material.

4. The roof structure of claim 1 and further including strips of insulation material attached to the lower laterally extending flanges of said purlins and extending along the lengths of said purlins and covering the downwardly facing surfaces of the lower flanges of said purlins.

5. The roof structure of claim 1 and further including a lattice of straps extending between said purlins and supporting the central portions of said elongated strips of flexible sheet material.

6. The roof structure of claim 1 and further including a series of straps extending through said purlins and supporting the strips of flexible sheet material.

7. The roof structure of claim 1 and wherein the edge portions of the strips of flexible sheet material overlap the edge portions of adjacent strips of material at the upper laterally extending flanges of the purlins.

8. The roof structure of claim 1 and wherein the edge portions of the strips of flexible sheet material overlap the edge portions of adjacent strips of material at the upper laterally extending flanges of the purlins, and the edge portions of the adjacent strips of material are sealed together.

9. The roof structure of claim 1 and further including rigid panels of glass reinforced cellular plastic isocyanurate insulation fastened atop the upper laterally extending flanges of said purlins and extending along the lengths of said purlins and spanning the space between adjacent ones of said purlins and extending between the sheets of hard roofing material and the insulation material in said troughs.

10. A method of installing roof insulation to a roof structure of the type including a plurality of parallel spaced apart purlins with laterally extending upper and lower flanges and an intermediate central web comprising the steps of moving a reel of elongated flexible sheet material of a width wider than the space between adjacent ones of the purlins along the lengths of adjacent ones of the purlins and over the space between the purlins, unreeling the sheet material down into the space between the purlins as the reel is moved along the lengths of the purlins, forming and guiding the sheet material as it is unreeled to locate the edge portions of the sheet material on the upper surfaces of the upper flanges of the purlins and to locate the central portion of the sheet material at a lower level between the purlins, and placing insulation material on the central portions of the sheet material.

11. A method of installing roof insulation to a roof structure of the type including a plurality of parallel spaced apart purlins each with laterally extending upper and lower flanges and an intermediate central web, comprising the steps of supporting reels of sheet material of a width wider than the space between adjacent ones of the purlins on pairs of adjacent purlins, moving each real along the lengths of the purlins and unreeling the sheet material from the reels and forming the unreeled portion of the sheets in a trough-shape between adjacent ones of the purlins with the edge portions of the sheets of material positioned on the upper surfaces of the upper flanges of the purlins, sealing the edge portions of adjacent sheets of material together, placing heat insulation material in the troughs of the sheets of material, and placing hard sheets of roofing material over the insulation material and purlins.

12. A method of installing roof insulation to a roof structure of the type including a plurality of parallel spaced apart purlins comprising the steps of placing elongated flexible sheets of material of a width wider than the spaces between adjacent ones of the purlins along the lengths of adjacent ones of the purlins and over the spaces between adjacent ones of the purlins, forming the sheet material as it is placed on the purlins to locate the edge portions of the sheets of material on the upper surfaces of adjacent ones of the purlins and to locate the central portion of the sheets of material at a lower level between the purlins, sealing the edge portions of adjacent ones of the sheets together, and placing insulation material on the central portions of the sheet material.

* * * * *